US005370033A

United States Patent [19]

Bitsakis et al.

[11] Patent Number: 5,370,033

[45] Date of Patent: Dec. 6, 1994

[54] PRESSURE BALANCED FAST OPENING FIRING SYSTEM FOR A STORED ENERGY LAUNCHING SYSTEM

[75] Inventors: Nicholas Bitsakis, Portsmouth; Gary R. Berlam, Warwick, both of R.I.

[73] Assignee: The United States of America as represented by the Secretary of the Navy, Washington, D.C.

[21] Appl. No.: 129,726

[22] Filed: Sep. 30, 1993

[51] Int. Cl.[5] ..... F41F 3/10

[52] U.S. Cl. ..... 89/1.81; 114/238

[58] Field of Search ..... 89/1.809, 1.81; 114/238, 319

[56] References Cited

U.S. PATENT DOCUMENTS

| | | | |
|---|---|---|---|
| 5,082,122 | 2/1992 | Berlam et al. | 89/1.81 |
| 5,200,572 | 4/1993 | Bissonnette et al. | 89/1.81 |
| 5,210,369 | 5/1993 | Cassidy | 114/238 |

*Primary Examiner*—David Brown

*Attorney, Agent, or Firm*—Michael J. McGowan; Prithvi C. Lall; Michael F. Oglo

[57] ABSTRACT

A system for launching a projectile includes a source of stored energy such as a pressurized fluid, a projectile within a launch barrel which communicates with the source of pressurized fluid, a fluid flow path between the two having at least one flow port, an object for blocking the at least one flow port and a valve for moving the blocking object and thereby allowing the pressurized fluid to enter the launch barrel and initiate launch of the projectile. The valve for moving the blocking object communicates directly with the energy storage device of the launch system and is used to move the blocking means by introducing fluid against a rear face thereof. In one embodiment of the present invention, the blocking object may be a disposable poppet. In an alternative embodiment, it may be the projectile itself. The launch system of the present invention has the advantages of being relatively simple, quiet and highly reliable. It also has the advantage of very rapidly opening a flow port substantially equal in size to the projectile to be launched.

13 Claims, 1 Drawing Sheet

PRESSURE BALANCED FAST OPENING FIRING SYSTEM FOR A STORED ENERGY LAUNCHING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to a system for launching projectiles and more particularly, to a valve used in a projectile launching system which has the capability to rapidly launch the projectile without substantial noise by utilizing the stored internal energy of the launcher system.

2. Description of the Prior Art

Stored energy launcher systems for launching projectiles are known in the art. These systems typically use a stored pressurized fluid such as pressurized water to launch the projectile. They require a very fast opening, large diameter valve to effectively deliver the stored energy to the launched projectile. A slow opening valve can not be used in these systems because it throttles the pressurized fluid as it is being delivered to the projectile resulting in sluggish performance of the launch system.

At the present, stored energy launchers utilize a mechanical latch to restrain the projectile until time of firing. This type of mechanical latching arrangement is prone to failure due to the relatively large number of mechanical parts involved. Additionally, this arrangement suffers from the problem of generating high levels of acoustic noise as a result of friction, mechanical contact and vibration.

The size and speed of the mechanical valve required for a stored energy system can add tremendously to the complexity of the valve. A large flow port is required to minimize hydraulic losses. In addition, the time from initial opening to full opening of the valve must be minimized to enable a rapid launch of the projectile. High pressure, six-inch diameter ball valves used in launch systems with a hydraulic operator can take three to five seconds to open. Such opening times are unacceptable from the standpoint of having a rapid firing launching system.

SUMMARY OF THE INVENTION

It is therefore a principal object of the present invention to provide a projectile launcher system which opens a large flow path from a stored energy source to the projectile in a very short time.

It is a further object of the present invention to provide a projectile launching system as above which is relatively quiet from a noise standpoint.

It is yet a further object of the present invention provide a projectile launch system as above which uses a relatively small diameter valve to open a large flow port between a stored energy source and a projectile to be launched.

Further objects and advantages of the present invention will become more apparent from the following description and drawings.

The above objects are realized by the projectile launching system of the present invention. In accordance with the present invention, the system includes a projectile within a launch barrel; a source of pressurized fluid for launching the projectile; a fluid flow path having at least one flow port for delivering the pressurized fluid from the source to the launch barrel; means for blocking the at least one flow port; ant valve means for causing a flow of pressurized fluid which moves the blocking means and allows pressurized fluid from the source to enter the launch barrel and initiate launch of the projectile. As described herein, the valve means preferably comprises a normally closed, fluidic valve positioned intermediate the source of pressurized fluid and a rear portion of the launch barrel. When the valve is opened, fluid flow is initiated through the valve into a rear portion of the launch barrel. The pressurized fluid introduced in this manner contacts a rear face of the blocking means and causes the blocking means to move to a position wherein the at least one flow port is opened. This arrangement allows opening of the flow port(s) to occur from an initial opening to full open in a substantially instantaneous manner.

The projectile launch system of the present invention offers the following advantages and features. First, it is a relatively simple system utilizing just one small valve to initiate the opening of a relatively large flow port. It is also a quiet system in that there are no noise generating mechanical components. Still further, its reliability is a function of one single valve. Most importantly however is the ability to instantaneously open a flow port substantially equal in size to the projectile to be launched.

DESCRIPTION OF THE PREFERRED EMBODIMENT

Figure 1:
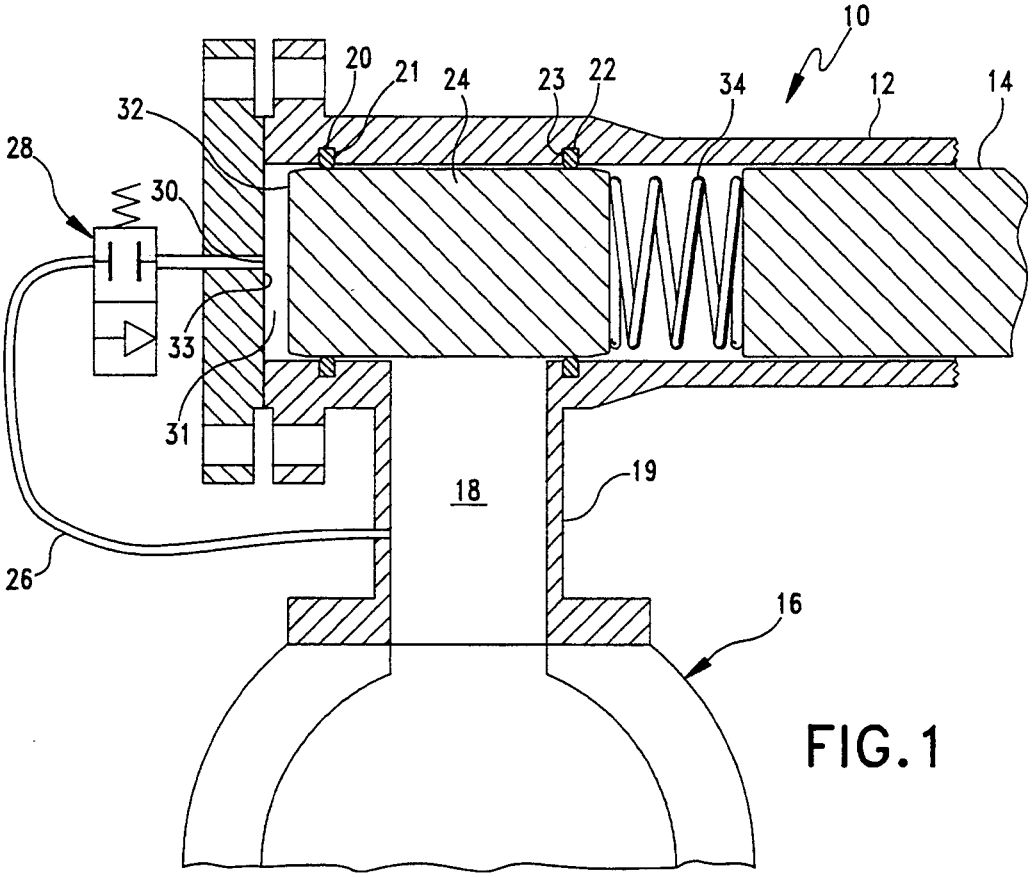
FIG. 1 is a cross-sectional representation of a fast opening firing system for a stored energy projectile launcher in accordance with the present invention.
Figure 2:
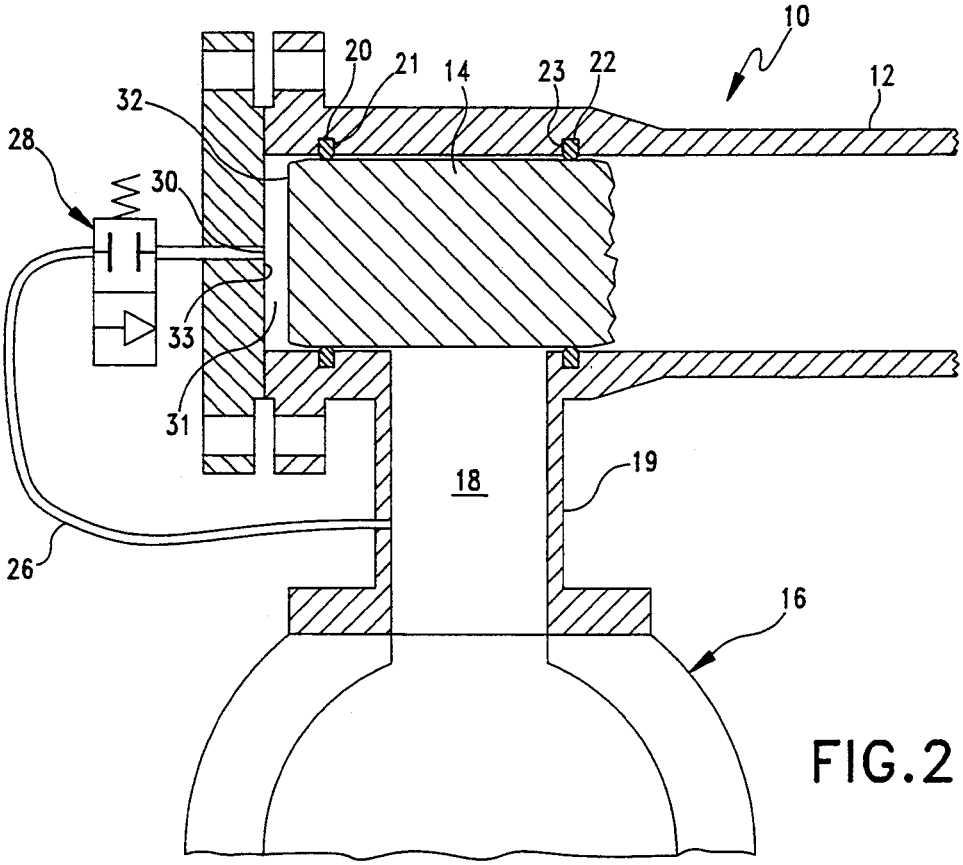
FIG. 2 is a cross-sectional representation of an alternative embodiment of a fast opening firing system for a stored energy projectile launcher in accordance with the present invention.

FIG. 1 and FIG. 2 illustrates a stored energy launch system (10) for a projectile. The system may be used in any environment. For example, it may be used on board marine vessels to launch projectiles through the hull.

The system 10 as shown in the figures includes a launch barrel 12 and a projectile 14 positioned within the launch barrel. The projectile 14 may be maintained at a desired position within the launch barrel in any suitable manner. For example, a spring (not shown) may be used to position the projectile relative to a launch barrel opening (not shown).

As shown in the figures, the system also includes an energy storage device 16 which acts as a source of energy for launching the projectile. The energy storage device 16 may comprise any suitable means known in the art for storing a pressurized fluid such as pressurized water. One system which may be utilized is the elastomeric bladder system shown in U.S. Pat. No. 4,848,210, which is incorporated by reference herein.

Pressurized fluid from the energy storage device 16 is supplied to the launch barrel 12 via flow path 18. In a preferred embodiment of the present invention, the flow path 18 is formed by a conduit portion 19 of the launch barrel having a cross-sectional area substantially equal to the cross-sectional area of the main launch barrel 12.

As shown in the figures, there are two spaced apart O-rings 20, 22 mounted within grooves 21, 23 machined in the launch barrel. Each O-ring has an inner periphery which defines a flow port having a diameter and cross-sectional area substantially equal to the diameter and cross-sectional area of the projectile 14. In one embodiment of the present invention (See FIG. 1), a substantially cylindrical object 24 is positioned within the launch barrel 12 so as to be in simultaneous contact with both O-rings 20, 22. If desired, grooves 21 and 23 can also be machined into the cylindrical object 24. This substantially cylindrical object 24 prevents a flow of pressurized fluid from the energy storage device 16 to the launch barrel 12 through the flow ports. The cylindrical object 24 in a preferred embodiment of the present invention comprises a disposable, pressure balanced, substantially cylindrical poppet. The poppet is pressure balanced since the pressures are equal on both sides due to the presence of the O-rings 20, 22. The poppet 24 may be formed from any suitable metallic or non-metallic material known in the art. The manner in which it operates will become clear from the following description.

The launch system further includes a bypass line 26, a normally closed, fluidic valve 28 within the bypass line and a discharge port 30 which allows fluid to be discharged into a compartment 31 defined by a rear face 32 of the poppet 24 and a rear wall 33 of the launch barrel 12. The valve 28 may comprise any suitable small diameter valve known in the art such as a solenoid operated valve. As used herein the term "small diameter valve" means a valve which has a flow opening in the range of from about ⅜ inch to about ½ inch in diameter.

As shown in the figures, the valve 28 communicates with the source 16 of pressurized fluid so that when the valve is activated, high pressure fluid from the source 16 flows into the compartment 31 through the valve 28 and discharge port 30 and contacts the rear face of the substantially cylindrical poppet 24 blocking the flow port defined by the O-ring 20. By introducing pressurized fluid into the compartment 31 in this manner, the substantially cylindrical poppet 24, which acts as a blocking object, will be caused to move to the right to a position where it no longer contacts the O-ring 20. The flow port defined by O-rings 20 and 22 will become fully open as soon as the end 32 of poppet 24 passes O-ring 22. Thus, initial opening of the flow port to the full open position occurs very rapidly. Initial opening to full opening of the valve is defined as the point where the rear face 32 of the poppet 24 travels from O-ring 20 to O-ring 22. Once the flow port defined by O-ring 20 is opened, fluid from the energy storage device 16 freely contacts the rear face 32 of poppet 24 and continues propelling the object 24 and the projectile 14 out of launch barrel 12. Since the only force acting against the valve as it tries to reach the fully open position is seal friction between O-ring 22 and poppet 24 and a large force is applied to end 32 of poppet 24 by the pressurized fluid contained in the energy storage device 16, the valve opening time is very rapid. The valve 28 may be activated to an open position in any desired manner.

As shown in FIG. 1, a spring 34 is positioned intermediate the projectile 14 and the poppet 24. The purpose of this spring is to assist in the positioning of the projectile 14 within the launch barrel 12. If desired, the spring 34 may be omitted.

It should be noted that this invention provides a solution for opening a relatively large flow path from a stored energy source to a projectile in a very short time. As previously mentioned, the flow port(s) defined by each O-ring has a diameter and cross-sectional area substantially equal to that of the projectile 14.

One advantage of the system of the present invention is that it utilizes the same energy source to open the flow port as it does to launch the projectile. Thus, extra energy need not be added to the system to fire the device. It is also a simple fluid system utilizing just one small diameter valve to open a large flow port. With respect to the valve, it need be only large enough to prevent possible contaminants in the fluid from clogging the valve. The speed at which water flows through the valve is irrelevant since valve opening time, as described in detail above, occurs almost simultaneously as soon as the left edge of the blocking device 24 passes the O-ring seal 20.

In an alternative embodiment of the present invention (See FIG. 2), the cylindrical blocking object 24 may be omitted. The device for blocking the flow of fluid from the pressurized source 16 to the launch barrel, could be the projectile 14 itself. In such an arrangement, the outer periphery of the projectile 14 would contact the O-rings 20, 22.

As can be seen from the foregoing discussion, the system of the present invention is a relatively simple one. It will be quiet since there are no noise generating mechanical components. Additionally, it has the ability of instantaneously opening a flow port equal in size to the device to be launched and to launch the projectile within about 0.05 seconds. Still further, the system will be highly reliable since it will be a function of one single solenoid valve which may be activated in any desired manner.

It should also be recognized that the concept of the present invention may be used for any size or type of stored energy launch system. The same performance will be realized for any size flow port to be opened.

It is apparent that there has been provided in accordance with this invention a pressure balanced fast opening firing system for a stored energy launcher system which fully satisfies the objects, means and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

What is claimed is:

1. A system for launching a projectile which comprises:

a projectile within a launch barrel;

a source of pressurized fluid for launching said projectile.

a fluid flow path having at least one flow port for delivering said pressurized fluid from said source to said launch barrel;

means for blocking said at least one flow port so that fluid from said source is substantially prevented from entering said launch barrel; and valve means for creating a flow of fluid into said launch barrel which moves said blocking means and allows said pressurized fluid from said source to enter said launch barrel and initiate launch of said projectile, said valve means communicating with said pressurized fluid source and being located externally of said launch barrel.

2. The system of claim 1 wherein said valve means comprises a solenoid actuated valve.

3. The system of claim 1 wherein said valve means comprises a fluidic valve having an orifice diameter of from about $\frac{3}{8}$ inch to about $\frac{1}{2}$ inch.

4. The system of claim 1 wherein said projectile has a desired diameter and each said flow port has a diameter substantially equal to said projectile diameter.

5. The system of claim 1 wherein said source of pressurized fluid comprises an elastomeric bladder.

6. The system of claim 1 further comprising:

two spaced apart O-rings mounted within said launch barrel to prevent said pressurized fluid from flowing into said launch barrel; and said blocking means being formed by an outer periphery of a substantially cylindrical object.

7. The system of claim 1 further comprising:

two spaced apart O-rings, mounted on said blocking means, to prevent said pressurized fluid from flowing into said launch barrel; and said blocking means being formed by an outer periphery of a substantially cylindrical object.

8. The system of claim 1 further comprising:

said valve means comprising means for facilitating a flow of pressurized fluid into said launch barrel sufficient to enable said projectile to be launched within about 0.05 seconds.

9. The system of claim 1 wherein said at least one flow port is defined by an O-ring mounted within said launch barrel.

10. The system of claim 9 wherein said blocking means comprises said projectile.

11. A system for launching a projectile which comprises:

a projectile within a launch barrel;

a source of pressurized fluid flow for launching said projectile;

a fluid flow path having at least one flow port for delivering said pressurized fluid from said source to said launch barrel;

means for blocking said at least one flow port;

valve means for creating a fluid flow which moves said blocking means and allows said said source to enter said launch barrel and initiate launch of said projectile;

said at least one flow port being defined by ring mounted within said launch barrel; and said blocking means comprising a disposable, substantially cylindrical poppet.

12. The system of claim 11 further comprising:

a spring positioned intermediate said poppet and said projectile; and said spring positioning said projectile within said launch barrel.

13. A system for launching a projectile which comprising:

a projectile within a launch barrel;

a source of pressurized fluid for a fluid flow path having at least one flow port for delivering said pressurized fluid from said source to said launch barrel;

means for blocking said at least one flow port;

valve means for creating a fluid flow which moves said blocking means and allows said said source to enter said launch barrel and initiate launch of said projectile;

a compartment within said launch barrel defined by a rear wall of said barrel and a rear face of said blocking means;

a fluid bypass line connecting said source to said valve means;

a discharge port in said rear wall of said launch barrel; and said valve means when activated allowing pressurized fluid from said source into said compartment via said discharge port and applying said pressurized fluid against said rear face, thereby causing said blocking means to move and substantially instantaneously open said at least one flow port.

* * * * *